US007163421B1

(12) United States Patent
Cohen et al.

(10) Patent No.: US 7,163,421 B1
(45) Date of Patent: Jan. 16, 2007

(54) HIGH SPEED HIGH DENSITY ELECTRICAL CONNECTOR

(75) Inventors: Thomas S. Cohen, New Boston, NH (US); Brian Kirk, Amherst, NH (US); Marc B. Cartier, Jr., Dover, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/183,564

(22) Filed: Jul. 18, 2005

Related U.S. Application Data

(60) Provisional application No. 60/695,705, filed on Jun. 30, 2005.

(51) Int. Cl.
*H01R 13/648* (2006.01)

(52) U.S. Cl. ..... 439/608; 439/108

(58) Field of Classification Search ..... 439/608, 439/108

See application file for complete search history.

(56) References Cited

U.S. PATENT DOCUMENTS 6,293,827 B1 9/2001 Stokoe
6,709,294 B1 * 3/2004 Cohen et al. ..... 439/608
6,776,659 B1 8/2004 Stokoe et al.
6,786,771 B1 * 9/2004 Gailus ..... 439/608

* cited by examiner

*Primary Examiner*—Tho D. Ta
(74) *Attorney, Agent, or Firm*—Blank Rome LLP

(57) ABSTRACT

An electrical connector includes a wafer formed with a ground shield made from a non-conductive material made conductive with conductive particles disposed therein, thereby eliminating the necessity of the metal ground shield plate found in prior art connectors while maintaining sufficient performance characteristics and minimizing electrical noise generated in the wafer. The wafer housing is formed with a first, insulative housing at least partially surrounding a pair of signal strips and a second, conductive housing at least partially surrounding the first, insulative housing and the signal strips. The housings provide the wafer with sufficient structural integrity, obviating the need for additional support structures or components for a wafer. Ground strips may be employed in the wafer and may be formed in the same plane as the signal strips. The second, conductive housing may be connected (e.g., molded) to the ground strips and spaced appropriately from the signal strips. The wafer may also include air gaps between the signal strips of one wafer and the conductive housing of an adjacent wafer further reducing electrical noise or other losses (e.g., cross-talk) without sacrificing significant signal strength.

35 Claims, 6 Drawing Sheets

HIGH SPEED HIGH DENSITY ELECTRICAL CONNECTOR

RELATED APPLICATIONS

This application claims the benefit of U.S. Provisional Patent Application Ser. No. 60/695,705, filed Jun. 30, 2005, entitled "High Speed, High Density Electrical Connector", which is hereby incorporated herein by reference.

BACKGROUND OF INVENTION

1. Field of Invention

This invention relates generally to electrical interconnection systems and more specifically to improved signal integrity in interconnection systems, particularly in high speed electrical connectors.

2. Discussion of Related Art

Electrical connectors are used in many electronic systems. It is generally easier and more cost effective to manufacture a system on several printed circuit boards ("PCBs") which are then connected to one another by electrical connectors. A traditional arrangement for connecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling the increased bandwidth.

As frequency content increases, there is a greater possibility of energy loss. Energy loss can be attributed to impedance discontinuities, mode conversion, leakage from imperfect shielding, or undesired coupling to other conductors (crosstalk). Therefore, connectors are designed to control the mechanisms the enable energy loss. Conductors composing transmission paths are designed to match system impedance, enforce a known propagating mode of energy, minimize eddy currents, and isolate alternate transmission paths from one another. One example of controlling energy loss is the placement of a conductor connected to a ground placed adjacent to a signal contact element to determine an impedance and minimize energy loss in the form of radiation.

Cross-talk between distinct signal paths can be controlled by arranging the various signal paths so that they are spaced further from each other and nearer to a shield. Thus, the different signal paths tend to electromagnetically couple more to the shield and less with each other. For a given level of cross-talk, the signal paths can be placed closer together when sufficient electromagnetic coupling to the ground conductors is maintained.

Although conductors are typically isolated from one another with shields are typically made from metal components, U.S. Pat. No. 6,709,294 (the '294 patent), which is assigned to the same assignee as the present application and which is hereby incorporated by reference in its entirety, describes making an extension of a shield plate in a connector from conductive plastic.

Electrical connectors can be designed for single-ended signals as well as for differential signals. A single-ended signal is carried on a single signal conducting path, with the voltage relative to a common reference conductor being the signal.

Differential signals are signals represented by a pair of conducting paths, called a "differential pair." The voltage difference between the conductive paths represents the signal. In general, the two conducting paths of a differential pair are arranged to run near each other. No shielding is desired between the conducting paths of the pair but shielding may be used between differential pairs.

One example of a differential pair electrical connector is shown in U.S. Pat. No. 6,293,827 (the '827 patent), which is assigned to the assignee of the present application. The '827 patent discloses a differential signal electrical connector that provides shielding with separate shields corresponding to each pair of differential signals. U.S. Pat. No. 6,776,659 (the '659 patent), which is assigned to the assignee of the present application, shows individual shields corresponding to individual signal conductors. Ideally, each signal path is shielded from all other signal paths in the connector. Both the '827 patent and the '659 patents are hereby incorporated by reference in their entireties.

U.S. Pat. No. 6,786,771, (the '771 patent), which is assigned to the assignee of the present application and which is hereby incorporated by reference in its entirety, describes the use of lossy material to reduce unwanted resonances and improve connector performance, particularly at high speeds (for example, signal frequencies of 1 GHz or greater, particularly above 3 GHz).

SUMMARY OF INVENTION

In one aspect, the invention relates to a wafer for an electrical connector having a plurality of wafers. The wafer includes a housing comprising a first, insulative housing and a second, conductive housing. The wafer also includes a plurality of signal strips disposed within the first, insulative housing. The first, insulative housing includes an insulative material securing the plurality of signal strips and spacing the plurality of signal strips from the second, conductive housing. The second, conductive housing is formed of a non-conductive binder material having conductive particles disposed therein thereby rendering the second, conductive housing conductive. The second, conductive housing is configured and arranged relative to the plurality of signal strips to shield at least some of the plurality of signal strips to reduce or eliminate electrical noise, with the wafer being free of a metal shield plate.

In another aspect, the invention relates to a wafer for an electrical connector having a plurality of wafers. The wafer includes a housing comprising a first, insulative housing and a second, conductive housing. The wafer also includes a plurality of signal strips disposed within the first, insulative housing. The first, insulative housing includes an insulative material securing the plurality of signal strips and spacing the plurality of signal strips from the second, conductive housing. At least one ground strip is disposed within and electrically coupled to the second, conductive housing. The at least one ground strip is disposed in a plane and the plurality of signal strips is disposed in the same plane. The second, conductive housing is formed of a non-conductive binder material having conductive particles disposed therein thereby rendering the second, conductive housing conductive. The second, conductive housing being configured and arranged relative to the plurality of signal strips to shield at least some of the plurality of signal strips to reduce or eliminate electrical noise.

In yet another aspect, the invention relates to a wafer for an electrical connector having a plurality of wafers. The wafer includes a housing comprising a first, insulative housing and a second, conductive housing. A plurality of signal strips is disposed within the first, insulative housing. The first, insulative housing includes an insulative material securing the plurality of signal strips and spacing the plurality of signal strips from the second, conductive housing. The plurality of signal strips defines a first signal pair and a second signal pair. The second, conductive housing is at least partially formed of a non-conductive binder material having conductive particles disposed therein thereby rendering the second, conductive housing conductive. The second, conductive housing is configured and arranged relative to the plurality of signal strips to shield at least some of the plurality of signal strips to reduce or eliminate electrical noise. The first, insulative housing is disposed on a first side of the plurality of signal strips and wherein the first, insulative housing and the second, conductive housing are configured to provide an air gap on a second, opposite side of the plurality of signal strips when at least two wafers are disposed adjacent each other. The air gap includes a first air gap over the first signal pair and a second, separate air gap over the second signal pair.

In still another aspect, the invention relates to a wafer for an electrical connector having a plurality of wafers. The wafer includes a housing comprising a first, insulative housing and a second, conductive housing. The second, conductive housing is formed of a non-conductive binder material having conductive particles disposed therein thereby rendering the second, conductive housing conductive. The second, conductive housing has a substantially planar portion and an upstanding portion. The wafer also includes a plurality of signal strips disposed within the first, insulative housing. The first, insulative housing includes an insulative material securing the plurality of signal strips and spacing the plurality of signal strips from the second, conductive housing. The second, conductive housing is configured and arranged relative to the plurality of signal strips to shield at least some of the plurality of signal strips to reduce or eliminate electrical noise. The substantially planar portion of the second, conductive housing has a thickness of up to about 2.0 mm and the upstanding portion is adapted to space the plurality of signal strips of one wafer from plurality of signal strips of an adjacent wafer by a distance of about 1.85 mm to about 4 mm.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
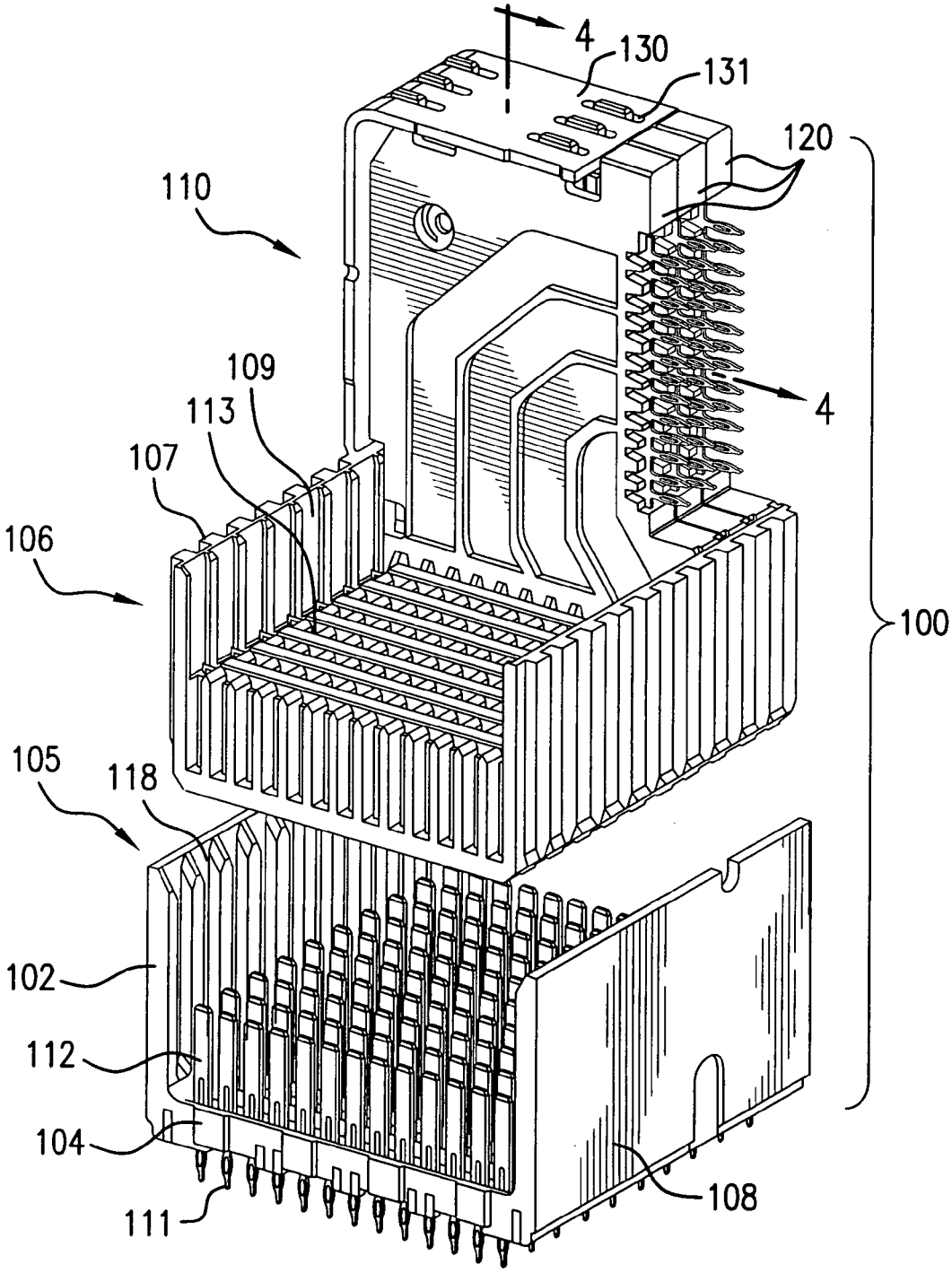
FIG. 1 is an illustrative embodiment of an electrical connector according to the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Conventional daughter board connectors are typically formed from a plurality of individual wafers coupled together. Each wafer includes a signal frame molded within a non-conductive housing. A metal ground shield plate and connected metal strips may be employed within the wafer to minimize electrical noise generated in the wafer in forms such as reflections, impedance, cross-talk and electromagnetic radiation between signal lines and/or between signal pairs. In some wafers, the metal ground shield is used in conjunction with a conductive or semi-conductive molded first housing portion, such a plastic material having conductive particles dispersed throughout.

One embodiment of the present invention may reduce manufacturing cost and complexity of these prior art wafers by forming the entire ground shield from a material less costly than metal, such as a less costly non-conductive material made conductive, e.g., a plastic material containing conductive fillers, thereby eliminating the necessity of the metal ground shield plate found in prior art wafers while maintaining or increasing performance characteristics. In one embodiment, the ground shield is provided by the housing which comprises two portions, a first insulative portion that holds and separates conductive signal pairs and a second conductive portion to provide the desired electric isolation. The housing may be formed with sufficient structural integrity to provide adequate support throughout the wafer.

In one embodiment, conductive ground strips in the wafer are formed in the same plane as the conductive signal strips and the second housing portion (i.e., that portion of the housing that is conductive) is connected (e.g., molded) to the ground strips and spaced appropriately from the signal strips.

To obtain the desired performance characteristics at acceptable manufacturing costs, one embodiment of the present invention may employ air gaps or holes, air channels or other shapes between the conductive strips (e.g., signal strips) of one wafer and the conductive housing of an adjacent wafer to further reduce electrical noise or other losses (e.g., cross-talk) without sacrificing significant signal strength. This phenomenon occurs, at least in part, because the air gap provides preferential signal communication or coupling between one signal strip of a signal pair and the other signal strip of the signal pair, whereas shielding is used to limit cross-talk amongst signal pairs.

Referring to FIG. 1, one embodiment of a multi-piece electrical connector 100 is shown to include a backplane connector 105, front housing 106 and a daughter board connector 110. The backplane connector 105 includes a backplane shroud 102 and a plurality of signal contacts 112, here arranged in an array of differential signal pairs. In the illustrated embodiment, the signal contacts are grouped in pairs, such as might be suitable for manufacturing a differential signal electrical connector. A single-ended configuration of the signal contacts 112 is also contemplated in which the signal conductors are evenly spaced. In the embodiment illustrated, the backplane shroud 102 is molded from a dielectric material. Examples of such materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to the invention.

The signal contacts 112 extend through a floor 104 of the backplane shroud 102 providing a contact area both above and below the floor 104 of the shroud 102. Here, the contact area of the signal contacts 112 above the shroud floor 104 are adapted to mate to signal contacts in front housing 106. In the illustrated embodiment, the mating contact area is in the form of a blade contact, although other suitable contact configurations may be employed, as the present invention is not limited in this regard.

A tail portion 111 of the signal contact 112 extends below the shroud floor 104 and is adapted to mate to a printed circuit board. Here, the tail portion is in the form of a press fit, "eye of the needle" compliant contact. However, other configurations are also suitable, such as surface mount elements, spring contacts, solderable pins, etc., as the present invention is not limited in this regard. In one embodiment, the daughter board connector 110 mates with the front housing 106, which in turn mates with the backplane connector 105 to connect the signal traces in a backplane (not shown) to signal contacts 112.

The backplane shroud 102 further includes side walls 108 which extend along the length of opposing sides of the backplane shroud 102. The side walls 108 include grooves 118 which run vertically along an inner surface of the side walls 108. Grooves 118 serve to guide front housing 106 via mating projections 107 into the appropriate position in shroud 102. In some embodiments, a plurality of shield plates (not shown) may be provided and may run parallel with the side walls 108 are, located here between rows of pairs of signal contacts 112. In a single ended configuration, the plurality of shield plates would be located between rows of signal contacts 112. However, other shielding configurations could be formed, including having the shield plates running between the walls of the shrouds, transverse to the direction illustrated or omitting the shield plate entirely. If used, the shield plates may be stamped from a sheet of metal, or, as will become apparent hereinafter, may be formed of a non-conductive thermoplastic material made conductive with the addition of conductive fillers that houses conductive strips.

Each shield plate, if used, includes one or more tail portions, which extend through the shroud floor or base 104. As with the tails of the signal contacts, the illustrated embodiment has tail portions formed as an "eye of the needle" compliant contact which is press fit into the backplane. However, other configurations are also suitable such as surface mount elements, spring contacts, solderable pins, etc., as the present invention is not limited in this regard.

As mentioned above, the daughter board connector 110 includes a plurality of modules or wafers 120 that are supported by a support 130. Each wafer 120 includes features which are inserted into apertures 131 in the support to locate each wafer 120 with respect to another and further to prevent rotation of the wafer 120. Of course, the present invention is not limited in this regard, and no support need be employed. Further, although the support is shown attached to an upper and side portion of the plurality of wafers, the present invention is not limited in this respect, as other suitable locations may be employed.

For exemplary purposes only, the daughter board connector 110 is illustrated with three wafers 120, with each wafer 120 having a pair of signal conductors surrounded by or otherwise adjacent a ground strip. However, the present invention is not limited in this regard, as the number of wafers and the number of signal conductors and shield strips in each wafer may be varied as desired. Each wafer is inserted into front housing 106 along slots 109, such that the contact tails (not shown in FIG. 1) are inserted through mating connection openings 113 to as to make electrical connection with signal contacts 112 of the backplane connector 105.

Figure 2:
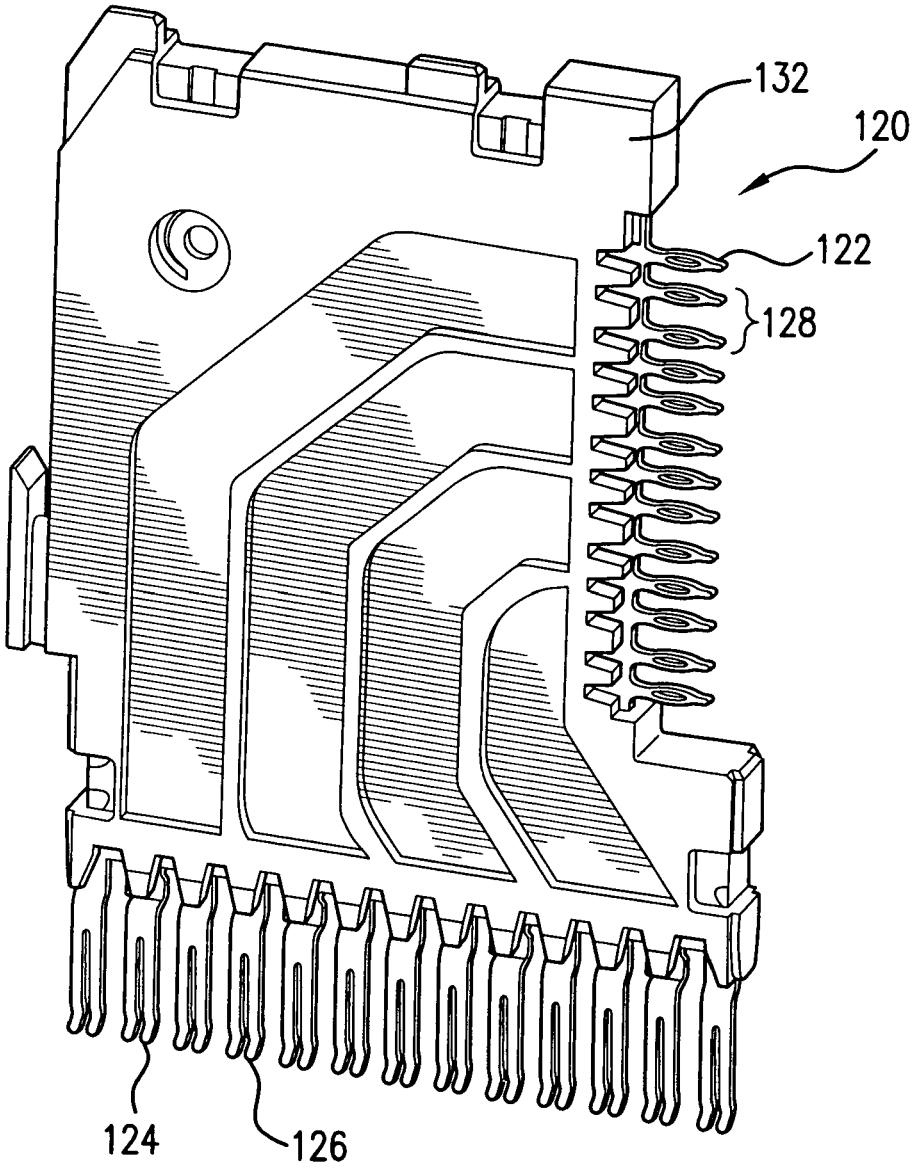
FIG. 2 is a sketch of a wafer forming a portion of the electrical connector of FIG. 1.

Referring now to FIG. 2, a single wafer of the daughter board connector is shown. Wafer 120 includes a two part housing 132 formed around a lead frame of signal strips and shield strips (also referred to as ground strips). Wafer 120 is preferably formed by molding a first insulative portion 150 (see FIG. 4) of the housing 132 around a sub-assembly of the lead frame. As will be described in more detail below, a second molding operation may be performed to mold the second, conductive portion 151 (see FIG. 4) of the housing 132 around the sub-assembly of the lead frame molded to the first insulative portion 150.

Extending from a first edge of each wafer 120 are a plurality of signal contact tails 128 and a plurality of shield contact tails 122, which extend from first edges of the corresponding strips of the lead frame. In the example of a board to board connector, these contact tails connect the signal strips and the shield strips to a printed circuit board. In a preferred embodiment, the plurality of shield contact tails and signal contact tails 122 and 128 on each wafer 120 are arranged in a single plane, although the present invention is not limited in this respect. Also in a preferred embodiment, the plurality of signal strips and ground strips on each wafer 120 are arranged in a single plane, although the present invention is not limited in this respect.

Here, both the signal contact tails 128 and the shield contact tails 122 are in the form of press fit "eye of the needle" compliants which are pressed into plated through holes located in a printed circuit board (not shown). In the preferred embodiment, it is intended that the signal contact tails 128 connect to signal traces on the printed circuit board and the shield contact tails 122 connect to a ground plane in the printed circuit board. In the illustrated embodiment, the signal contact tails 128 are configured to provide a differential signal and, to that end, are arranged in pairs.

Near a second edge of each wafer 120 are mating contact regions 124 of the signal contacts which mate with the signal contacts 112 of the backplane connector 105. Here, the mating contact regions 124 are provided in the form of dual beams to mate with the blade contact end of the backplane signal contacts is 112. In the embodiment shown, the mating contact regions 124 are exposed. However, the present invention is not limited in this respect and the mating contact regions may be positioned within openings in dielectric housing 132 to protect the contacts. Openings in the mating face of the wafer allow the signal contacts 112 to also enter those openings to allow mating of the daughter board and backplane signal contacts. Other suitable contact configurations may be employed, as the present invention is not limited in this regard.

Provided between the pairs of mating contact regions 124 and also near the second edge of the wafer are shield beam contacts 126. Shield beam contacts 126 are connected to daughter board shield strips and engage an upper edge of the backplane shield plate if employed, when the daughter board connector 110 and backplane connector 105 are mated. In an alternate embodiment (not shown), the beam contact is provided on the backplane shield plate and a blade is provided on the daughter board shield plate between the pairs of dual beam contacts 124. It should be appreciated that the present invention is not limited to the specific shape of the shield contact shown, as other suitable contacts may be employed. Thus, the illustrated contact is exemplary only and is not intended to be limiting.

Figure 3A:
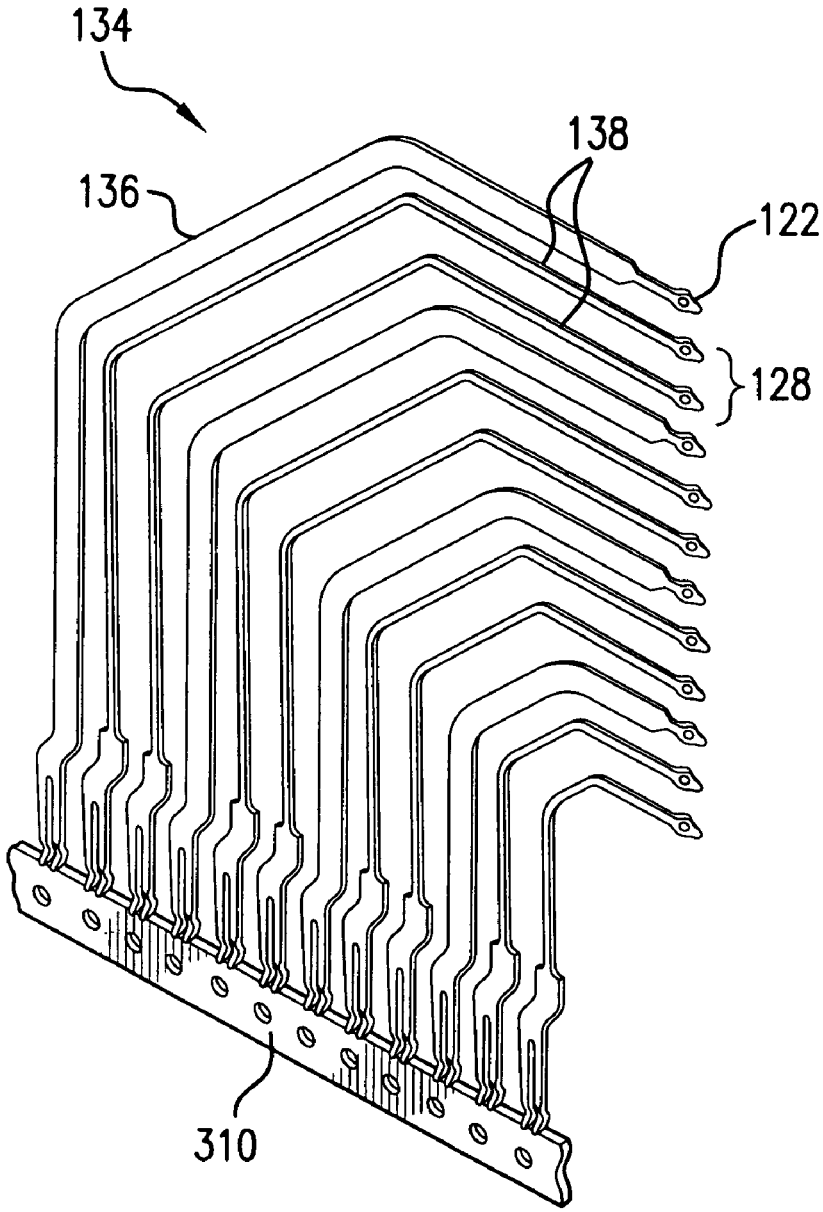
FIGS. 3A and 3B are sketches of alternative embodiments of a component of the wafer of FIG. 2 at a stage in its manufacture.

FIG. 3A shows a lead frame 134 for one embodiment of a wafer at an intermediate step of manufacture. Here, shield strips 136 and signal strips 138 are attached to a carrier strip 310. In one embodiment, strips 136, 138 will be stamped for many wafers on a single sheet of metal. A portion of the sheet of metal will be retained as the carrier strip 310. The individual components can then be more readily handled. When manufacturing is completed, the finished wafers 120 can then be severed from the carrier strip and assembled into daughter board connectors. Although the carrier strip is shown formed adjacent the contacts 124, 126, the present invention is not limited in this respect, as other suitable locations may be employed, such as at the ends/tails of contacts 122, 128, between the ends, or at any other suitable location. Further, the sheet of metal may be formed such that one or more additional carrier strips are formed at other locations and/or a bridging member located between conductive strips may be employed for added support during manufacture. Therefore, the carrier strip shown is illustrative only and not intended to be limiting.

To form the completed wafer, as briefly mentioned above, an insulative portion 150 of the housing 132 can be molded over the lead frame 134 using any suitable molding technique, such as insert molding. In one embodiment, the insulative housing material is molded over at least the signal strips. Next, the conductive housing material is molded over the insulative housing 150 with signal strips. At least the conductive portion 151 of the housing 132 may be molded to leave windows 324 through the housing, as desired. Various other features may be molded into housing 132, such as areas of reduced thickness, areas of increased thickness, channels, cavities, etc. as the present invention is not limited in this respect. Also, the front face of housing 132 may create the mating face of the connector and contains holes (not shown) to receive the mating contact portion from the backplane connector, as is known in the art. The walls of holes protect the mating contact area. Once molding is complete, as mentioned, carrier strip 310 can be removed from the lead frame 134.

Figure 3B:
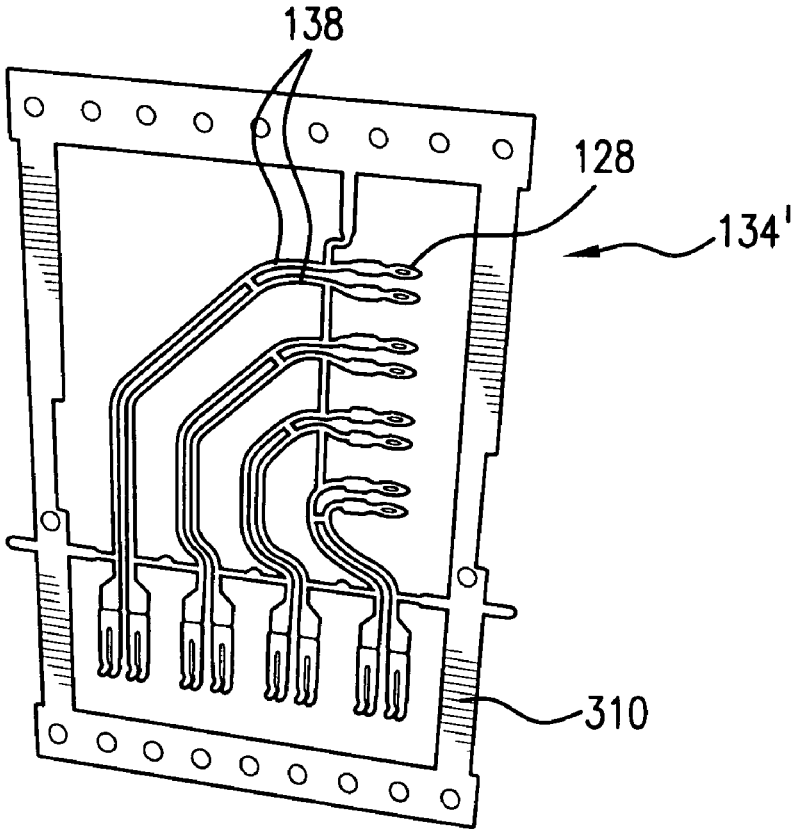

Although the lead frame 134 is shown as including both the ground strips 136 and the signal strips 138, the present invention is not limited in this respect and the respective strips can be formed in two separate lead frames. Thus, in an alternative embodiment, the signal strips may be formed on the lead frame 134' shown in FIG. 3B. Ground strips 136 shown in FIG. 3A may be formed on a separate lead frame or individually, as desired, as molded into the housing along with the lead frame 134'. In such an embodiment, using suitable molding techniques such as insert molding, one of the lead frames is molded in place first, with the molding process forming a cavity in the portion of the housing being molded so as to receive the other lead frame. Then, the other lead frame is positioned in the cavity and a second molding operation is performed to mold about the other lead frame. Alternatively, both lead frames can be molded into the housing simultaneously. Also, one or more lead frames for the signal strips may be utilized as the present invention is not limited in this respect. Indeed, no lead frame need be placed and individual strips may be employed during manufacture. It should be appreciated that molding over the one or both lead frames, or the individual strips, need not be performed at all, as the wafer may be assembled by inserting shield and signal strips into preformed housing portions, which may then be secured together with various features including snap fit features.

According to the invention, all or portions of the second housing portion are formed from a material that selectively alters the electrical and/or electromagnetic properties of the second housing portion, thereby suppressing noise and/or cross talk, altering the impedance of the signal conductors or otherwise imparting desirable electrical properties to the wafer. In this manner, the second housing portion can be made to simulate a metal shield plate insert so that, according to the present invention, the metal shield plate can be replaced in total. The use of plastics filled with electromagnetic materials for at least a portion of the housing allows electromagnetic interference between signal conductors to be reduced. In a preferred embodiment, second housing portion 151 is molded with materials that contain conductive filler to render the second housing conductive. If sufficiently conductive, the second housing portion with the conductive filler obviates the need for a metal shield plate. Even if not fully conductive, the filled plastic can absorb signals radiating from the signal conductors that would otherwise create cross-talk.

Prior art electrical connector molding materials are generally made from a thermoplastic binder into which non-conducting fibers are introduced for added strength, dimensional stability and to reduce the amount of higher priced binder used. Glass fibers are typical, with a loading of about 30% by volume.

In one embodiment of the invention, electromagnetic fillers, such as those described below, are used in place of or in addition to the glass fibers for all or portions of the second housing portion. The fillers can be conducting or can be ferromagnetic, depending on the electrical properties that are desired from the material. In one embodiment, the second housing portion is formed with one or more materials that provide lossy conductivity (also referred to as "electrically lossy").

Materials that conduct, but with some loss, over the frequency range of interest are referred to herein generally as "electrically lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between about 1Ω/square and about $10^6$Ω/square. In some embodiments, the electrically lossy material has a surface resistivity between about 1Ω/square and about $10^3$Ω/square. In some embodiments, the electrically lossy material has a surface resistivity between about 10Ω/square and about 100Ω/square.

In some embodiments, electrically lossy material is formed by adding a filler that contains conductive particles to a binder. Examples of conductive particles that may be used as a filler to form an electrically lossy material include carbon or graphite formed as fibers, flakes, nickel-graphite powder or other particles. Metal in the form of powder, flakes, fibers, stainless steel fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers. Nanotube materials may also be used. Blends of materials might also be used.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material. In another embodiment, the binder is loaded with conducting filler between 10% and 80% by volume. More preferably, the loading is in excess of 30% by volume. Most preferably, the conductive filler is loaded at between 40% and 60% by volume.

When fibrous filler is used, the fibers preferably have a length between about 0.05 mm and about 15 mm. More preferably, the length is between about 0.3 mm and about 3.0 mm.

In one contemplated embodiment, the fibrous filler has a high aspect ratio (ratio of length to width). In that embodiment, the fiber preferably has an aspect ratio in excess of 10 and more preferably in excess of 100.

Filled materials can be purchased commercially, such as materials sold under the trade name Celestran® by Ticona. A lossy material, such as lossy conductive carbon filled adhesive preform, such as those sold by Techfilm of Billerica, Mass., U.S. may also be used. This preform can include an epoxy binder filled with carbon particles. The binder surrounds carbon particles, which acts as a reinforcement for the preform. When inserted in a wafer 120 to form all or part of the housing, the preform adheres to the shield strips. In one embodiment, the preform adheres through the adhesive in the preform, which is cured in a heat treating process. The preform thereby provides electrically lossy connection between the shield strips. Various forms of reinforcing fiber, in woven or non-woven form, coated or non-coated may be used. Non-woven carbon fiber is one suitable material. Other suitable materials, such as custom blended as sold by RTP Company, can be employed, as the present invention is not limited in this respect.

Preferably, the binder material is a thermoplastic material that has a reflow temperature in excess of 250° C. and more preferably in the range of 270–280° C. LCP and PPS are examples of suitable material. In the preferred embodiment, LCP is used because it has a lower viscosity. Preferably, the binder material has a viscosity of less than 800 centipoise at its reflow temperature without fill. More preferably, the binder material has a viscosity of less than 400 centipoise at its reflow temperature without fill.

The viscosity of the molding material when filled should be low enough so that it preferably can be molded with readily available molding machinery. When filled, the molding material preferably has a viscosity below 2000 centipoise at its reflow temperature and more preferably a viscosity below 1500 centipoise at its reflow temperature. It should be appreciated that the viscosity of the material can be decreased during molding operation by increasing its temperature or pressure. However, binders will break down and yield poor quality parts if heated to too high a temperature. Also, commercially available machines are limited in the amount of pressure they can generate. If the viscosity in the molding machine is too high, the material injected into the mold will set before it fills all areas of the mold.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used. Also, while the above described binder material are used to create an electrically lossy material by forming a binder around conducting particle fillers, the invention is not so limited. For example, conducting particles may be impregnated into a formed matrix material. As used herein, the term "binder" encompasses a material that encapsulates the filler or is impregnated with the filler.

In accordance with one embodiment, prior art molding materials are used to create the portions of the connector housing that need to be non-conducting to avoid shorting out signal contacts or otherwise creating unfavorable electrical properties. Also, in one embodiment, those portions of the housing for which no benefit is derived by using a material with different electromagnetic properties are also made from prior art molding materials, because such materials are generally less expensive and may be mechanically stronger than ones filled with electromagnetic materials.

Figure 4:
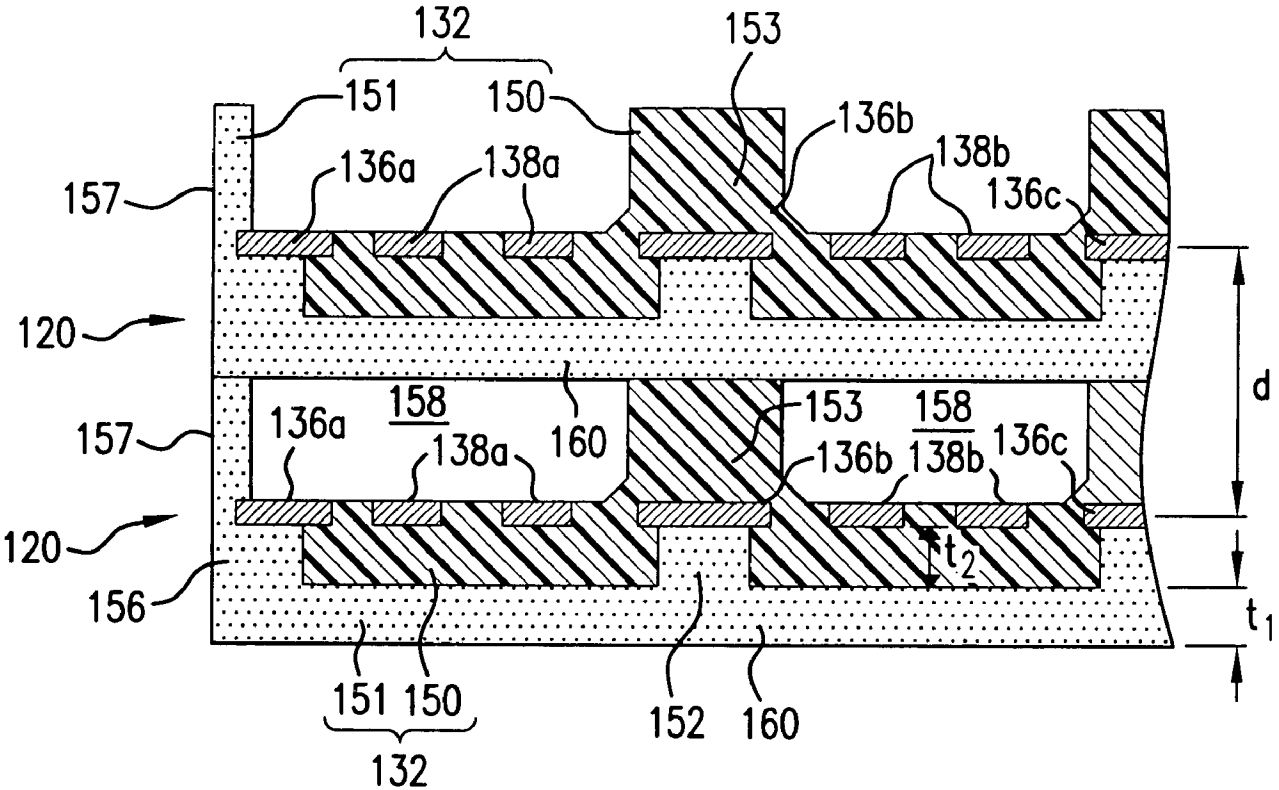
FIG. 4 is a cross-sectional representation of a portion of a connector taken along line 4—4 of FIG. 1.

One embodiment of a daughter board connector is shown in FIG. 4, which is a cross-sectional representation of a portion of the connector of FIG. 1. In particular, FIG. 4 shows a cross-section of a portion of two wafers 120, each molded with two types of material according to the invention. Second housing portion 151 is formed of a material having a conductive filler, whereas first housing portion 150 is formed of an insulating material having little or no conductive fillers. According to the invention, second housing portion 151 is sufficiently conductive to eliminate the need for a separate metal ground plate.

As shown in FIG. 4, the ground strips 136*a*, 136*b* . . . , are connected to the second housing portion 151, which, as discussed above, can be accomplished during the molding of this portion of the housing to the ground strips. In one embodiment, ground strip 136*b* includes an opening through which the material forming the housing can flow, thereby securing the ground strip in place. Other suitable methods for securing the ground strip may be employed, as the present invention is not limited in this respect. According to the invention, the conductive housing 151 and the ground strips 136*a*, 136*b*, . . . cooperate to shield the signal strips 138*a*, 138*b*, . . . to limit noise, such as electromagnetic coupling, between pairs of signal strips. As described above, the housing 151 may be grounded to the system within which the daughter board connector is employed through one or more ground contacts formed at the ends of the ground strips.

Forming the second housing portion 151 from a moldable conductive material can provide additional benefits. For example, the shape at one or more locations can be altered to change the performance of the connector at that location, by, for example, changing the thickness of the second housing portion in certain locations to space the conductive strip closer to or further away from the second housing portion. As such, electromagnetically coupling between one pair of signal strips and ground and another pair of signal strips and ground can be altered, thereby shielding some signal strips more so than others and thereby altering the local characteristics of the wafer. In one embodiment, the conductive particles disposed in the second, conductive housing are disposed generally evenly throughout, rendering a conductivity of the second, conductive housing generally constant. In another embodiment, a first portion of the second, conductive housing is more conductive than a second portion of the second, conductive housing so that the conductivity of the second housing portion may vary.

Further, as shown in FIG. 4, wafer 120 is designed to carry differential signals. Thus, each signal is carried by a pair of signal conductors. And, preferably, each signal conductor is closer to the other conductor in its pair than it is to a conductor in an adjacent pair. For example, a pair of signal conductors 138*a* carries one differential signal and signal conductors 138*b* carry another differential signal. Thus, projection 152 of the second housing portion 151 is positioned between these pairs to provide shielding between the adjacent differential signals. Projection 157 is at the end of the column of signal conductors in wafer 120. It is not shielding adjacent signals in the same column. However, having shielding projections at the end of the row helps prevent noise or cross-talk from column to column.

To prevent signal conductors 138*a*, 138*b* . . . from being shorted together through conductive housing 151 and/or to prevent any signal conductor from being shorted to ground through either a shield strip or the housing 151, as discussed above, insulative housing portion 150, formed of a suitable dielectric material, is used to insulate the signal strips. Although as discussed the insulative housing portion 150, in one embodiment, is molded with the conductive strips first and then the second, conductive housing is molded over in a second molding operation, the present invention is not limited in this respect, as the conductive housing may be molded first and the insulative housing portion with conductive strips (i.e., at least the signal strips) can be molded to the conductive housing in a second molding operation. Of course, other suitable molding techniques may be employed to create either housing portion, as the present invention is not limited in this regard. In one embodiment, as shown, insulative housing includes upstanding portion 153 disposed between adjacent signal pairs.

Although not required, the insulative portion 150 may be provided with windows (not shown) adjacent the signal conductors 124. These windows are intended to generally serve multiple purposes, including to: (i) ensure during an injection molding process that the signal strips are properly positioned, (ii) provide impedance control to achieve desired impedance characteristics, and (iii) facilitate insertion of materials which have electrical properties different than insulative portion 150, if so desired.

According to another aspect of the invention, no insulative material nor any conductive material of the second housing is provided over the signal strips; rather, an air gap 158 is provided between the signal strips of one wafer with the conductive housing of an adjacent wafer. Of course, the present invention is not limited in this respect and the same insulative portion 150 (or a different insulative material) may be used to fill the air gap.

As mentioned, the air gap over the signal pair can provide preferential coupling between the conductors of the signal pair while decreasing the relative coupling between adjacent signal pairs (i.e., cross-talk). Further, the upstanding projection 152 located between signal pairs also acts to decrease coupling between adjacent signal pairs.

In addition, the ability to place air in close proximity to one half of a signal pair provides a mechanism to de-skew the signals within a pair. The time it takes an electrical signal to propagate from one end of the connector to the other end is known as the propagation delay. It is important that each signal within a pair have the same propagation delay, which is commonly referred to as having zero skew within the pair. The propagation delay within a connector or transmission line structure is due to the dielectric constant, where a lower dielectric constant means a lower propagation delay. The dielectric constant is also known as the relative permittivity. Air or vacuum has the lowest possible dielectric constant with a value of 1, whereas dielectric material, such as LCP, has a higher value. For example, LCP has a dielectric constant of between about 2.5 and about 4.5. Each half of the signal pair typical has different physical length. According to one aspect of the invention, to make the signals have identical propagation delays, even though they have physically different lengths, the proportion of the dielectric material and air around any conductor is adjusted. In other words, more air is moved in close proximity to the physically longer pair, thus lowering the effective dielectric constant around the signal pair and decreasing its propagation delay. As the dielectric constant is lowered, the impedance of the signal rises. To maintain balanced impedance within the pair, the size of the metal conductor used for the signal in closer proximity to the air is increased in thickness or width. This results in two signal conductors with different physical geometry, but an identical propagation delay and impedance profile.

In some instances, it may be beneficial to provide direct contact from the shield of one wafer to the shield of an adjacent wafer to further minimize noise. For instance, metal conductors that are used to electrically isolate signal paths from one another (shields) may often support an electromagnetic mode of propagation between them. This alternate mode may be seen in measurements as a resonance. One method of moving this resonance out of the area of interest is to short together the conductors at a maximum voltage point.

According to one aspect of the invention, the conductive housing 151 is molded to provide a generally planar portion 160 and a generally upstanding support portion 157. In addition to spacing the conductors of one wafer from the housing of an adjacent wafer by a suitable amount, support portion 157 can also be used to provide direct electrical communication from the conductive housing 151 of one wafer with the conductive housing of an adjacent wafer.

To provide the adequate structural integrity, yet provide the desired electrical characteristics, in one embodiment, the thickness ($t_1$) of the substantially planar portion 160 of the conductive housing 151 is up to about 2.0 mm. In another embodiment, the thickness ($t_1$) is between about 0.025 mm and about 1.5 mm. In another embodiment, the thickness ($t_1$) is between about 0.25 mm and about 0.75 mm. The thickness ($t_1$) of the substantially planar portion need not be relatively constant. In this manner, the electrical characteristics of the conductive housing 151 can be locally altered. That is, one portion of the conductive housing 151 may have electrical characteristics that are different from other portions of the conductive housing 151. In one embodiment, the distance (d) separating the plane of conductive strips of one wafer with the plane of conductive strips of an adjacent wafer is between about 1 mm and about 4 mm. In another embodiment, the distance (d) is between about 1.5 mm and about 4 mm. In a preferred embodiment, the distance (d) is between about 1.85 mm and about 4.0 mm. In one embodiment, the thickness ($t_2$) of the insulative portion 150 of the housing as measured from the conductive portion 151 of the housing to the underside of a conductive strip is up to about 2.5 mm. In another embodiment, the thickness ($t_2$) is between about 0.25 mm and about 2.5 mm. In another embodiment, the thickness ($t_2$) is between about 0.5 mm and about 2.0 mm. As will be apparent to one of ordinary skill in the art, the thickness of the ground strips 136*a*, 136*b*, . . . and the signal strips 138*a*, 138*b*, . . . may vary depending on requirements, e.g., desired performance characteristics, manufacturing costs. In one embodiment, the thickness of the ground strips 136*a*, 136*b*, . . . and/or the signal strips 138*a*, 138*b*, . . . may be between about 0.1 mm to about 0.5 mm. Of course, other suitable thicknesses may be employed as the present invention is not limited in this regard.

Although FIG. 4 shows a ground strip molded in the conductive housing, the present invention is not limited in this respect, as the ground strip can be electrically coupled to the conductive housing by any suitable means. Further, in one embodiment, the ground strip need not be employed at all, provided that the conductive housing is either formed or configured in a manner to provide sufficient shielding of the signal strips to reduce noise to the desired level or eliminate it altogether. As described above, this may be accomplished by altering the dimensions of the conductive housing at desired locations and/or by altering the conductivity of the conductive housing at the desired location by, for example, increasing or decreasing the amount of conductive filler at the desired location.

According to another aspect of the invention, the connector system may include one or more features described in co-pending U.S. Provisional Patent Application No. 60/695,264 filed on Jun. 30, 2005 having Express Mail Mailing Label No. EV 493484392 U.S.), which is hereby incorporated by reference in its entirety. In one embodiment, the wafer is formed with cavities between the contacts of the signal conductors. The cavities are shaped to receive lossy inserts whereby crosstalk may be further reduced. In another embodiment, the front housing may be formed with shield plates also to aid in reducing cross-talk.

Figure 5:
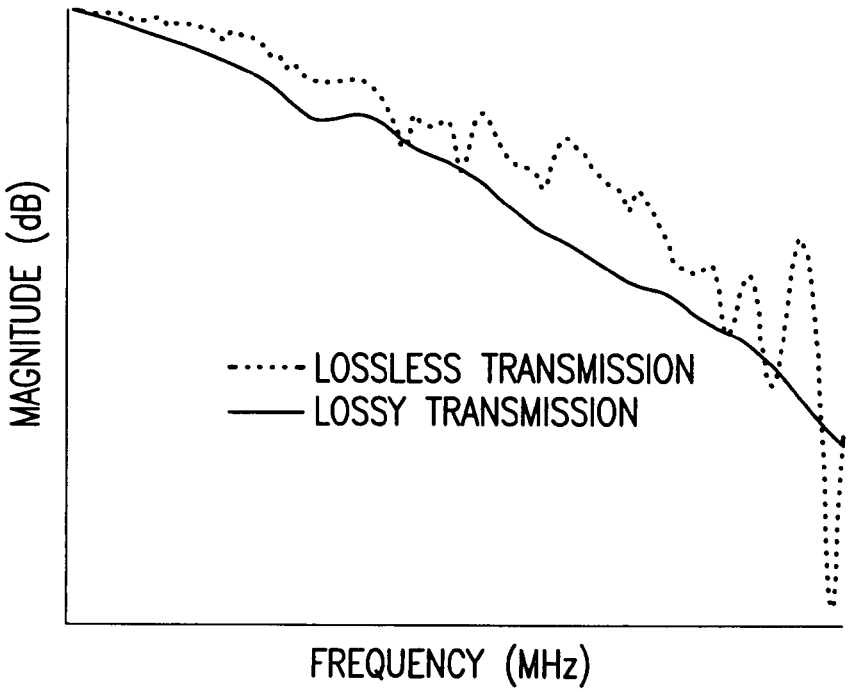
FIG. 5 is a graph showing a performance curve according to one embodiment of the invention.

As signaling speeds have risen to multigigabit data rates, it is necessary to compensate for the losses in the interconnect at the receiver to correctly identify the data. This technique is commonly referred to as equalization. The ability to compensate for the losses is dependent on the linearity of the performance curve. FIG. 5 shows the performance curve for an interconnect with lossless or low loss materials versus the performance of an interconnect lossy with structures purposely included. The uses of lossy or "electrically lossy" materials helps linearize the performance curve, which can enhance interconnect performance.

Having thus described several aspects of at least one embodiment of this invention, it is to be appreciated various alterations, modifications, and improvements will readily occur to those skilled in the art.

As one example, shielding may be provided by capacitively coupling an electrically lossy member to two structures. Because no direct conducting path need be provided, it is possible that the electrically lossy material may be discontinuous, with electrically insulating material between segments of electrically lossy material.

Further, portions of the conductive material forming the conductive housing are shown in planar layers. Such a structure is not required. For example, partially conductive regions may be positioned only between shield strips or only between selective shield strips such as those found to be most susceptible to resonances.

Further, although the inventive aspects are shown and described with reference to a daughter board connector, it should be appreciated that the present invention is not limited in this regard, as the inventive concepts may be included in other types of electrical connectors, such as backplane connectors, cable connectors, stacking connectors, mezzanine connectors, or chip sockets.

Such alterations, modifications, and improvements are intended to be part of this disclosure, and are intended to be within the spirit and scope of the invention. Accordingly, the foregoing description and drawings are by way of example only.

What is claimed is:

1. A wafer for an electrical connector having a plurality of wafers, the wafer comprising:

a housing comprising a first, insulative housing and a second, conductive housing; and a plurality of signal strips disposed within the first, insulative housing, the first, insulative housing comprising an insulative material securing the plurality of signal strips and spacing the plurality of signal strips from the second, conductive housing;

wherein the second, conductive housing is formed of a non-conductive binder material having conductive particles disposed therein thereby rendering the second, conductive housing conductive, the second, conductive housing configured and arranged relative to the plurality of signal strips to shield at least some of the plurality of signal strips to reduce or eliminate electrical noise, with the wafer being free of a metal shield plate.

2. The wafer of claim 1, wherein the first, insulative housing is disposed on a first side of the plurality of signal strips and wherein the first, insulative housing and the second, conductive housing are configured to provide an air gap on a second, opposite side of the plurality of signal strips when at least two wafers are disposed adjacent each other.

3. The wafer of claim 1, wherein the second, conductive housing is formed with a planar portion, with the planar portion having a thickness of up to about 2.0 mm.

4. The wafer of claim 1, wherein the second, conductive housing is formed with a planar portion and an upstanding portion, with the upstanding portion being adapted to electrically couple to a second, conductive housing of an adjacent wafer.

5. The wafer of claim 1, wherein the second, conductive housing is formed with a planar portion and an upstanding portion, with the upstanding portion being adapted to space the plurality of signal strips of one wafer from plurality of signal strips of an adjacent wafer by a distance of between about 1.85 mm and about 4.0 mm.

6. The wafer of claim 1, wherein the conductive particles disposed in the second, conductive housing are disposed generally evenly throughout.

7. The wafer of claim 1, wherein a first portion of the second, conductive housing is more conductive than a second portion of the second, conductive housing.

8. The wafer of claim 1, wherein the second, conductive housing is formed with a planar portion and wherein the first, insulative housing is disposed on a first side of the plurality of signal strips and between the plurality of signal strips and the planar portion of the second, conductive housing, with the first, insulative housing having a thickness up to about 2.5 mm.

9. The wafer of claim 1, wherein the second, conductive housing is formed of an electrically lossy material.

10. The wafer of claim 1, further comprising at least one ground strip disposed within and electrically coupled to the second, conductive housing.

11. A method of forming the wafer of claim 10, comprising:

molding the first, insulative housing at least partially about the plurality of signal strips; and molding the second, conductive housing at least partially about the first, insulative housing and the plurality of signal strips and about the at least one ground strip, wherein molding the first, insulative housing and the second, conductive housing comprises forming the respective housing to produce a cavity to act as an air gap adjacent a pair of signal strips and produce a shield between adjacent pairs of signal strips.

12. The wafer of claim 10, wherein the at least one ground strip is disposed in a plane and wherein the plurality of signal strips is disposed in the same plane.

13. The wafer of claim 12, wherein the at least one ground strip is spaced from the plurality of signal strips.

14. The wafer of claim 13, wherein the first, insulative housing is constructed and arranged to space the signal strips from the ground strips.

15. The wafer of claim 1, wherein the second, conductive housing is constructed and arranged whereby an amount of shielding of a first one of the plurality of signal strips is different from an amount of shielding of a second one of the plurality of signal strips.

16. The wafer of claim 15, wherein the second, conductive housing is formed with a planar portion, with the planar portion having a first portion adjacent a first one of the plurality of signal strips and a second portion adjacent a second one of the plurality of signal strips, wherein the first portion has a first thickness and the second portion has a second thickness, wherein the first thickness is different from the second thickness.

17. A wafer for an electrical connector having a plurality of wafers, the wafer comprising:

a housing comprising a first, insulative housing and a second, conductive housing;

a plurality of signal strips disposed within the first, insulative housing, the first, insulative housing comprising an insulative material securing the plurality of signal strips and spacing the plurality of signal strips from the second, conductive housing; and at least one ground strip disposed within and electrically coupled to the second, conductive housing, wherein the at least one ground strip is disposed in a plane and wherein the plurality of signal strips is disposed in the same plane, wherein the second, conductive housing is formed of a non-conductive binder material having conductive particles disposed therein thereby rendering the second, conductive housing conductive, the second, conductive housing being configured and arranged relative to the plurality of signal strips to shield at least some of the plurality of signal strips to reduce or eliminate electrical noise.

18. The wafer of claim 17, wherein the first, insulative housing is disposed on a first side of the plurality of signal strips and wherein the first, insulative housing and the second, conductive housing are configured to provide an air gap on a second, opposite side of the plurality of signal strips when at least two wafers are disposed adjacent each other.

19. The wafer of claim 17, wherein the second, conductive housing is formed with a planar portion, with the planar portion having a thickness of up to about 2.0 mm.

20. The wafer of claim 17, wherein the second, conductive housing is formed with a planar portion and an upstanding portion, with the upstanding portion being adapted to electrically couple to a second, conductive housing of an adjacent wafer.

21. The wafer of claim 17, wherein the housing is formed with a planar portion and an upstanding portion, with the upstanding portion being adapted to space the plurality of signal strips of one wafer from plurality of signal strips of an adjacent wafer by a distance between about 1.85 mm and about 4.0 mm.

22. The wafer of claim 17, wherein the second, conductive housing is formed with a planar portion and wherein the first, insulative housing is disposed on a first side of the plurality of signal strips and between the plurality of signal strips and the planar portion of the second, conductive housing, with the first, insulative housing having a thickness of up to about 2.5 mm.

23. The wafer of claim 17, wherein the second, conductive housing is formed of an electrically lossy material.

24. A method of forming the wafer of claim 17, comprising:

molding the first, insulative housing at least partially about the plurality of signal strips; and molding the second, conductive housing at least partially about the first, insulative housing and the plurality of signal strips and about the at least one ground strip, wherein molding the first, insulative housing and the second, conductive housing comprises forming the respective housing to produce a cavity to act as an air gap adjacent a pair of signal strips and produce a shield between adjacent pairs of signal strips.

25. A wafer for an electrical connector having a plurality of wafers, the wafer comprising:

a housing comprising a first, insulative housing and a second, conductive housing; and a plurality of signal strips disposed within the first, insulative housing, the first, insulative housing comprising an insulative material securing the plurality of signal strips and spacing the plurality of signal strips from the second, conductive housing, the plurality of signal strips defining a first signal pair and a second signal pair, wherein the second, conductive housing is at least partially formed of a non-conductive binder material having conductive particles disposed therein thereby rendering the second, conductive housing conductive, the second, conductive housing configured and arranged relative to the plurality of signal strips to shield at least some of the plurality of signal strips to reduce or eliminate electrical noise, wherein the first, insulative housing is disposed on a first side of the plurality of signal strips and wherein the first, insulative housing and the second, conductive housing are configured to provide an air gap on a second, opposite side of the plurality of signal strips when at least two wafers are disposed adjacent each other, wherein the air gap comprises a first air gap over the first signal pair and a second, separate air gap over the second signal pair.

26. The wafer of claim 25, wherein the second, conductive housing is formed with a planar portion, with the planar portion having a thickness of up to about 2.0 mm.

27. The wafer of claim 25, wherein the second, conductive housing is formed with a planar portion and an upstanding portion, with the upstanding portion being adapted to electrically couple to a second, conductive housing of an adjacent wafer.

28. The wafer of claim 25, wherein the second, conductive housing is formed with a planar portion and an upstanding portion, with the upstanding portion being adapted to space the plurality of signal strips of one wafer from plurality of signal strips of an adjacent wafer by a distance between about 1.85 mm and about 4.0 mm.

29. The wafer of claim 25, wherein the second, conductive housing is formed with a planar portion and wherein the first, insulative housing is disposed on a first side of the plurality of signal strips and between the plurality of signal strips and the planar portion of the second, conductive housing, with the thickness of the first, insulative housing between the second, conductive housing and the plurality of signal strips being about 0.04 mm.

30. The wafer of claim 25, wherein the second, conductive housing is formed of an electrically lossy material.

31. A method of forming the wafer of claim 25, comprising:

molding the first, insulative housing at least partially about the plurality of signal strips; and molding the second, conductive housing at least partially about the first, insulative housing and the plurality of signal strips and about the at least one ground strip, wherein molding the first, insulative housing and the second, conductive housing comprises forming the respective housing to produce a cavity to act as an air gap adjacent a pair of signal strips and produce a shield between adjacent pairs of signal strips.

32. The wafer of claim 25, further comprising at least one ground strip disposed within and electrically coupled to the second, conductive housing.

33. The wafer of claim 32, wherein the at least one ground strip is disposed in a plane and wherein the plurality of signal strips is disposed in the same plane.

34. A wafer for an electrical connector having a plurality of wafers, the wafer comprising:

a housing comprising a first, insulative housing and a second, conductive housing, the second, conductive housing being formed of a non-conductive binder material having conductive particles disposed therein thereby rendering the second, conductive housing conductive, the second, conductive housing having a substantially planar portion and an upstanding portion; and a plurality of signal strips disposed within the first, insulative housing, the first, insulative housing comprising an insulative material securing the plurality of signal strips and spacing the plurality of signal strips from the second, conductive housing, wherein the second, conductive housing is configured and arranged relative to the plurality of signal strips to shield at least some of the plurality of signal strips to reduce or eliminate electrical noise, wherein the substantially planar portion of the second, conductive housing has a thickness of up to about 2.0 mm and wherein the upstanding portion is adapted to space the plurality of signal strips of one wafer from plurality of signal strips of an adjacent wafer by a distance of about 1.85 mm to about 4 mm.

35. A method of forming the wafer of claim 34, comprising:

molding the first, insulative housing at least partially about the plurality of signal strips; and molding the second, conductive housing at least partially about the first, insulative housing and the plurality of signal strips and about the at least one ground strip, wherein molding the first, insulative housing and the second, conductive housing comprises forming the respective housing to produce a cavity to act as an air gap adjacent a pair of signal strips and produce a shield between adjacent pairs of signal strips.

* * * * *